US007364150B2

(12) United States Patent
Nakane

(10) Patent No.: US 7,364,150 B2
(45) Date of Patent: Apr. 29, 2008

(54) SHEET FEEDING APPARATUS AND IMAGE FORMING APPARATUS USING HEATING MEMBER ON SHEET TRAY

(75) Inventor: Yoshimitsu Nakane, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 11/342,596

(22) Filed: Jan. 31, 2006

(65) Prior Publication Data

US 2006/0170145 A1 Aug. 3, 2006

(30) Foreign Application Priority Data

Feb. 3, 2005 (JP) ..... 2005-027529

(51) Int. Cl.
*B65H 3/14* (2006.01)

(52) U.S. Cl. ..... 271/97; 271/90; 271/98

(58) Field of Classification Search ..... 271/90, 271/97, 98

See application file for complete search history.

(56) References Cited

U.S. PATENT DOCUMENTS 3,198,499 A * 8/1965 Stanley ..... 432/8
3,257,925 A * 6/1966 Ashburner ..... 355/106
3,294,396 A * 12/1966 Staines ..... 271/98
3,406,960 A * 10/1968 Del Vecchio et al. ..... 271/8.1
3,743,274 A * 7/1973 Komori ..... 271/3.2
4,184,672 A * 1/1980 Watkins et al. ..... 271/105
4,204,670 A * 5/1980 Traister ..... 271/287
4,699,369 A * 10/1987 Zirilli ..... 271/94
5,090,676 A * 2/1992 Matsuno et al. ..... 271/12
5,190,276 A * 3/1993 Namba et al. ..... 271/13
5,921,540 A * 7/1999 Acquaviva et al. ..... 271/98
6,398,206 B1 * 6/2002 Yang et al. ..... 271/90
6,726,200 B2 * 4/2004 Gohl et al. ..... 271/97
7,016,641 B2 * 3/2006 Matsumoto et al. ..... 399/390
2004/0061277 A1 * 4/2004 Dobbertin ..... 271/98
2005/0040584 A1 * 2/2005 Isemura ..... 271/97
2005/0053401 A1 * 3/2005 Matsumoto et al. ..... 399/390
2005/0206068 A1 * 9/2005 Sasaki et al. ..... 271/98
2007/0045932 A1 * 3/2007 Koga et al. ..... 271/97

FOREIGN PATENT DOCUMENTS

JP 3-211136 9/1991

* cited by examiner

*Primary Examiner*—Patrick H. Mackey
*Assistant Examiner*—Gerald W McClain
(74) *Attorney, Agent, or Firm*—Fitzpatrick, Cella, Harper & Scinto

(57) ABSTRACT

An air duct is disposed in the vicinity of a heating member generating the heat for heating sheets stacked in a sheet tray, and the air in the air duct is heated by the heat generated by the heating member. The air duct is connected to an air blowing portion blowing the air toward the sheets stacked in the sheet tray, and the air in the air duct that is heated by the heat generated by the heating member is blown toward the sheets stacked in the sheet tray by the air blowing portion.

8 Claims, 11 Drawing Sheets

SHEET FEEDING APPARATUS AND IMAGE FORMING APPARATUS USING HEATING MEMBER ON SHEET TRAY

BACKGROUND OF THE INVENTION

1. Field of the Invention

The present invention generally relates to a sheet feeding apparatus and an image forming apparatus, and more particularly to a feeding apparatus for separating and thus feeding sheets having high adhesiveness between the sheets.

2. Description of the Related Art

An image forming apparatus such as a copying machine and a printer conventionally includes a sheet feeding apparatus that sequentially feeds sheets stacked in a sheet stacking portion one by one from the uppermost sheet and thereafter feeds the sheets to an image forming portion.

In this type of sheet feeding apparatus, in the case of consecutively feeding the sheets, cut sheets are used, and these cut sheets are normally limited to free sheets and plain paper designated by a copying machine maker. Further, there have hitherto been adopted a variety of separating systems for surely separating these sheets one by one and thus feeding the sheets. This type of separating system may, for example, be a separating pad system for preventing double feeding by making a friction member abut, e.g., a feed roller with a predetermined pressure.

Another separating system is a retard type separating system. This system is one in which a separating portion is constructed of a feed roller rotating in a sheet feeding direction and a separating roller driven with a predetermined torque in a direction reversed to the sheet feeding direction and abutting the feed roller at a predetermined pressure. This separating portion permits passage of only the uppermost sheet of a sheet stack fed out by a pickup roller, and returns other sheets fed out following the uppermost sheet to the sheet stacking portion, thereby preventing the double feeding.

Herein, for surely separating and thus feeding the sheets by these separating systems, in the case of, for example, the retard type separating system, the sheets can be surely separated one by one in a way that optimizes a return torque and a pressurizing force of the separating roller by taking account of a friction force of the should-be-fed sheet.

By the way, with variety of sheet types (recording mediums), there are increasingly demands for forming images on sheets such as a coated sheet etc, of which the surface is subjected to a coating treatment in order to exhibit a whiteness degree and luster in response to a color-oriented market request in addition to super-thick sheets (carton boards), OHP sheets, art films and so on.

In the case of feeding the super-thick sheet, however, the super-thick sheet can not be picked up because its dead weight will resist conveying, and there is some fear that a jam will occur. Moreover, in the sheets made from an easy-to-charge resin material as in the case of the OHP sheet and the art film, the sheet surface is gradually becomes electrically charged due to friction between the sheets on the occasion of a feeding operation under a low-humidity environment, and will adhere to each other by dint of a Coulomb force. Hence, there is some fear that these sheets can not be picked up, and the double feeding occurs.

Further, the coated sheet of which the surface is coated with a coating substance composed of a coating material etc has a property that the sheets are adsorbed to each other in the case of being stacked under a high-humidity environment. Therefore, the coated sheets can not be picked up, and double feeding frequently occurs.

In the case of such a special type of sheets, the friction force itself between the sheets is equal to or smaller than that of the plain paper etc. However, the sheets are absorbed to each other by a much higher force than the friction force between the sheets with adsorbability (adhesion) caused by triboelectric charging under the low-humidity environment in the case of the resin material sheet and with the adsorbability under the high-humidity environment in the case of the coated sheet, and hence the sheets can not thoroughly be separated in the conventional separating systems. Namely, the conventional separating systems take account of only the friction force between the sheets, so that sheets can not be surely separated from each other when the adsorbability factors other than the friction force are present.

Such being the case, Japanese Patent Application Laid-Open Application No. H03-211136 proposes a technology for dissipating such high adsorbability between the sheets. This technology is that the sheets are previously raveled by blowing the air from the side surface (side end) of the sheet stack, and the adsorption (adhesion) between the sheets is vanished, in which state the sheets are picked up sheet by sheet from the upper sheet, and the separating portion provided downstream separates the sheets on a sheet-by-sheet basis. The sheet feeding apparatus using such a separation feeding system is adopted in a printing industry and in some of copying machines.

Herein, the reason why the air is blown is that the water content of the sheet is evaporated from the air flow between the sheets adsorbed to each other under the high-humidity environment, and the sheet is dried, thus reducing the adsorbability (adhesion). Accordingly, a raveling effect further rises when the air is hot air.

Then, in the separation feeding system including a portion (which will hereinafter be referred to as an auxiliary raveling portion) for blowing the air from the side surface of the sheet stack, the adsorption between even the sheets having the high adsorbability as described above can be dissipated by raveling the sheets in advance of feeding. Hence, separating performance is remarkably improved as compared with the already-described systems that simply utilize the friction force.

FIG. 11 is a view showing a construction of the conventional sheet feeding apparatus including the auxiliary air raveling portion. The construction and a function of this sheet feeding apparatus 100 will be explained. The sheets S are stacked in a sheet feeding deck 101, and the air supplied from a centrifugal separation type separating fan 102 is discharged obliquely upward from a raveling nozzle 103*a* at a predetermined wind speed and is thus blown into the side end of the sheets S.

Then, the air discharged obliquely upward from the raveling nozzle 103*a* enters the upper portion of the stack of sheets S, whereby some sheets, including the uppermost sheet S1, are floated. Hereafter, the uppermost floating sheet S1 is adsorbed onto a conveying belt 108. This conveying belt 108 is an endlessly-shaped belt composed of rubber and formed with a plurality of round holes 108*a* in predetermined positions, and is looped around two roller pairs 104, 105. Then, the sheet is adsorbed by a suction force of a centrifugal separation type suction fan 107 in a suction chamber 106 disposed in this conveying belt 108.

Herein, at this time, other than the uppermost sheet S1, a sheet S2 under the sheet S1 might be adsorbed. Therefore, the air discharged at a predetermined wind speed along the conveying belt 108 from a separating nozzle 103*b* also flows in between the adsorbed sheets S1 and S2, thereby peeling off the adsorbed sheets S1 and S2.

Next, when an adhesion sensor 109 detects that the uppermost sheet S1 is adsorbed onto the conveying belt 108, a drive roller 104 rotates in an arrowhead direction, whereby the sheet S1 is conveyed. Then, hereafter, the sheet S1 is pinched and conveyed by a draw-out roller pair 110, and, when a sheet feeding sensor ill detects a leading end of the sheet S1, the conveying belt 108 is stopped, and a negative pressure within the suction chamber 106 is canceled. With this operation, the sheet S1 is consecutively conveyed by the draw-out roller 110.

When the sheet S1 continues to be conveyed, and, when a sheet height detection sensor 112 detects that the uppermost sheet S1 reaches an incapable-of-adsorbing position by the conveying belt 108, a sheet tray 101*a* rises up to a predetermined position. A heater 113 is disposed on the air intake side of the separating fan 102, and the air from the separating fan 102 is heated by the heat generated in the heater 113 and is discharged toward the sheet S1 from the raveling nozzle 103*a* and the separating nozzle 103*b*.

In this type of conventional sheet feeding apparatus and in the image forming apparatus including this sheet feeding apparatus, however, other than blowing, against the sheet S1, the hot air heated by the heat generated by the heater 113, an unillustrated heater is provided within the sheet feeding deck 101 in order to improve separating performance. Then, the sheets S are warmed up by this heater in a state of being stacked in the sheet feeding deck 101, thereby restraining the adsorbability between the sheets S.

Namely, when stacked in the sheet feeding deck 101, the sheets S are warmed up by the unillustrated heater, and, when the sheets S get floating by the raveling nozzle 103 and when the sheets S are separated by the separating nozzle 103*b*, the hot air is blown against the sheets. This contrivance greatly reduces the adsorbability between the sheets S.

In the case of reducing the adsorbability between the sheets S by use of the two heaters such as the heater 113 and the unillustrated heater, however, though the sheets can be surely separated, the apparatus becomes complicated, and besides the electric power consumption increases.

SUMMARY OF THE INVENTION

It is an object of the present invention to provide a sheet feeding apparatus capable of saving energy and surely separating sheets with a simple configuration and an image forming apparatus including this sheet feeding apparatus.

According to one aspect of the invention, a sheet feeding apparatus comprising a sheet tray supporting a plurality of sheets, sheet feeding means feeding the sheets stacked in the sheet tray, air blowing device blowing the air toward the sheets stacked in the sheet tray, and one heating member provided at one of the sheet tray and the air blowing device and heating up the sheets stacked in the sheet tray and the air to be blown against the sheets by the air blowing device.

DESCRIPTION OF THE PREFERRED EMBODIMENTS

Embodiments of the present invention will hereinafter be described in detail with reference to the drawings.

Figure 1:
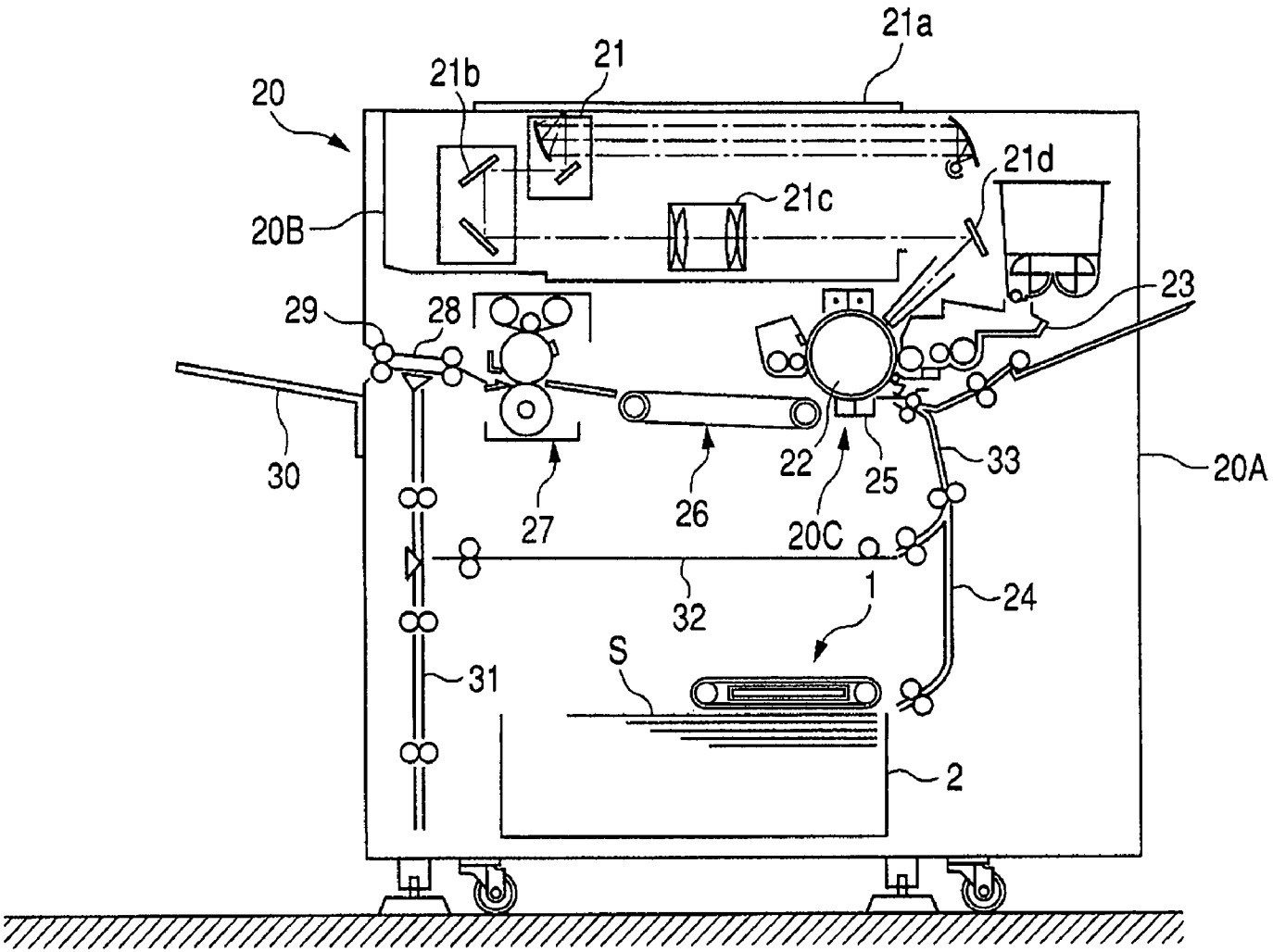
FIG. 1 is a view showing an outline of a configuration of a printer by way of one example of an image forming apparatus including a sheet feeding apparatus according to a first embodiment of the present invention.

FIG. 1 is a view showing an outline of a configuration of a printer by way of one example of an image forming apparatus including a sheet feeding apparatus according to a first embodiment of the present invention.

In FIG. 1, the numeral 20 represents a printer, and this printer 20 includes a printer body 20A and a scanner 20B disposed on an upper surface of the printer body 20A. The printer body 20A includes an image forming portion 20C having a photosensitive drum 22, a developing unit 23, etc, and a sheet feeding apparatus 1 for feeding, to the image forming portion 20C, a sheet S stored in a sheet feeding deck 2 so housed in the printer body 20A as to be withdrawable therefrom.

Herein, the scanner 20B, which reads an original, includes an original reading portion 21 for reading the unillustrated original pressed by a pressure plate 21*a* and, when reading the original, the original reading portion 21 irradiates the original pressed by the pressure plate 21*a* with light beams. Then, the photosensitive drum 22 is irradiated with the light beams from the original through a mirror 21*b*, a lens 21*c* and a mirror 21*d*. With this arrangement, a latent image is formed on the photosensitive drum 22, and thereafter this latent image is developed by a developing unit 23 into a toner image.

On the other hand, the sheet S stored in the sheet feeding deck 2 is conveyed by the sheet feeding apparatus 1 in parallel with the toner image forming operation via a conveyance path 24 and a conveyance path 33 to a transferring/separating portion 25 at such timing that the toner image on the photosensitive drum 22 is coincident with a sheet leading end. Then, this transferring/separating portion 25 transfers the toner image onto the sheet S and, thereafter, the sheet S onto which the toner image has been transferred is conveyed by a conveying portion 26 to a fixing apparatus 27.

Further, the sheet S conveyed to this fixing apparatus 27 is pressured and heated by the fixing apparatus 27, whereby the toner image is fixed. Thereafter, in the case of one-sided (simplex) copying, the sheet S is, after being conveyed to a sheet discharging roller 29 from a conveying path 28, discharged outside the printer body 20A by this sheet discharging roller 29 and is stacked in a sheet discharging tray 30.

Moreover, in the case of double-sided (duplex) copying, the sheet S is, after passing through the fixing apparatus 27 and after temporarily entering a reverse path 31 from the conveying path 28, switched back and thus enters a conveying route 32. Then, the sheet S is conveyed again to the transferring/separating portion 25 from a conveying path 33 via the conveying path 32. In this transferring/separating portion 25, the toner image is transferred onto the surface opposite to the previous side, and thereafter the sheet S is, after passing through the conveying portion 26, the fixing apparatus 27 and the conveying path 28, discharged outside the image forming apparatus 20 and is stacked in the sheet discharging tray 30.

Figure 2:
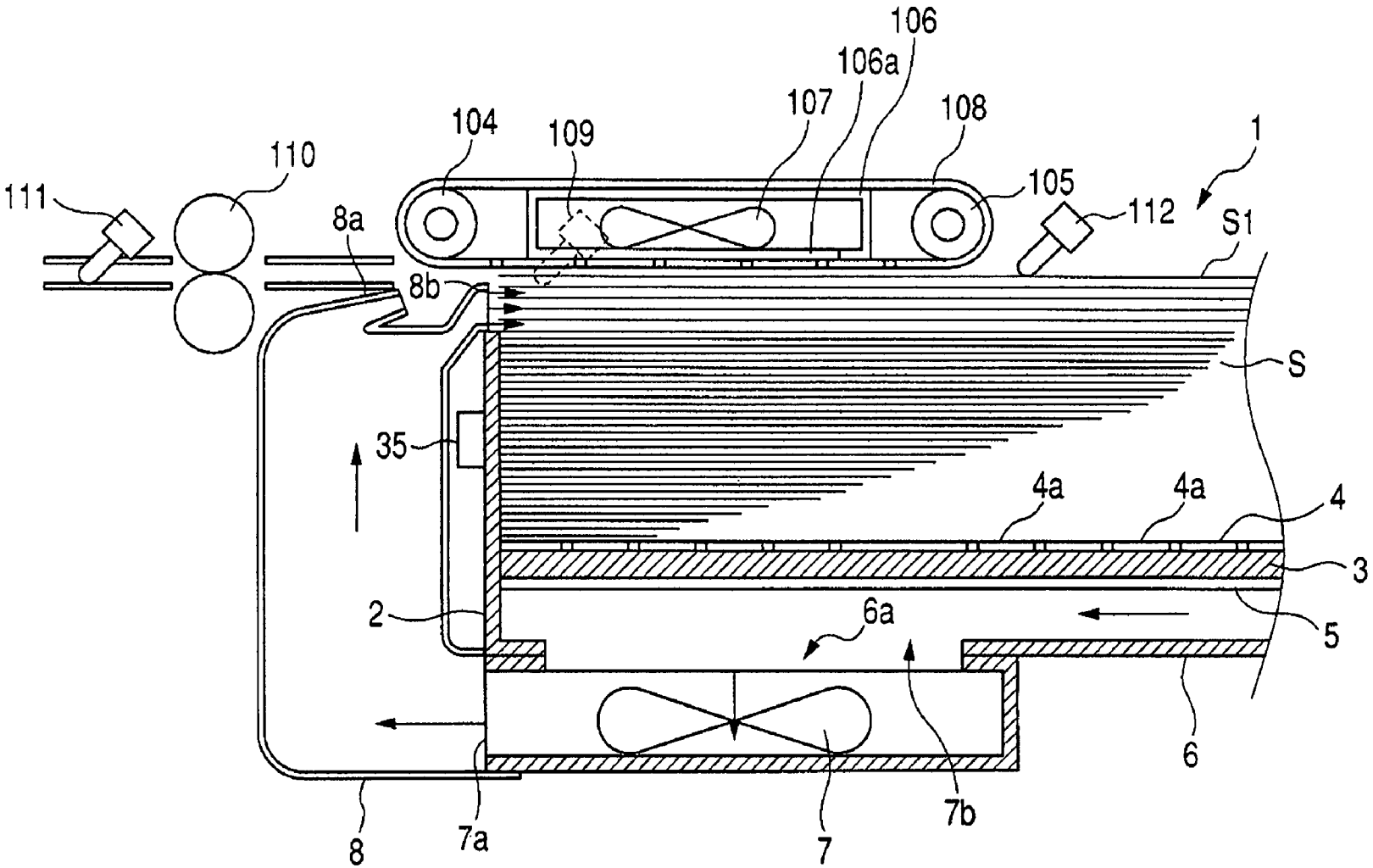
FIG. 2 is a view showing a configuration of the sheet feeding apparatus.
Figure 3:
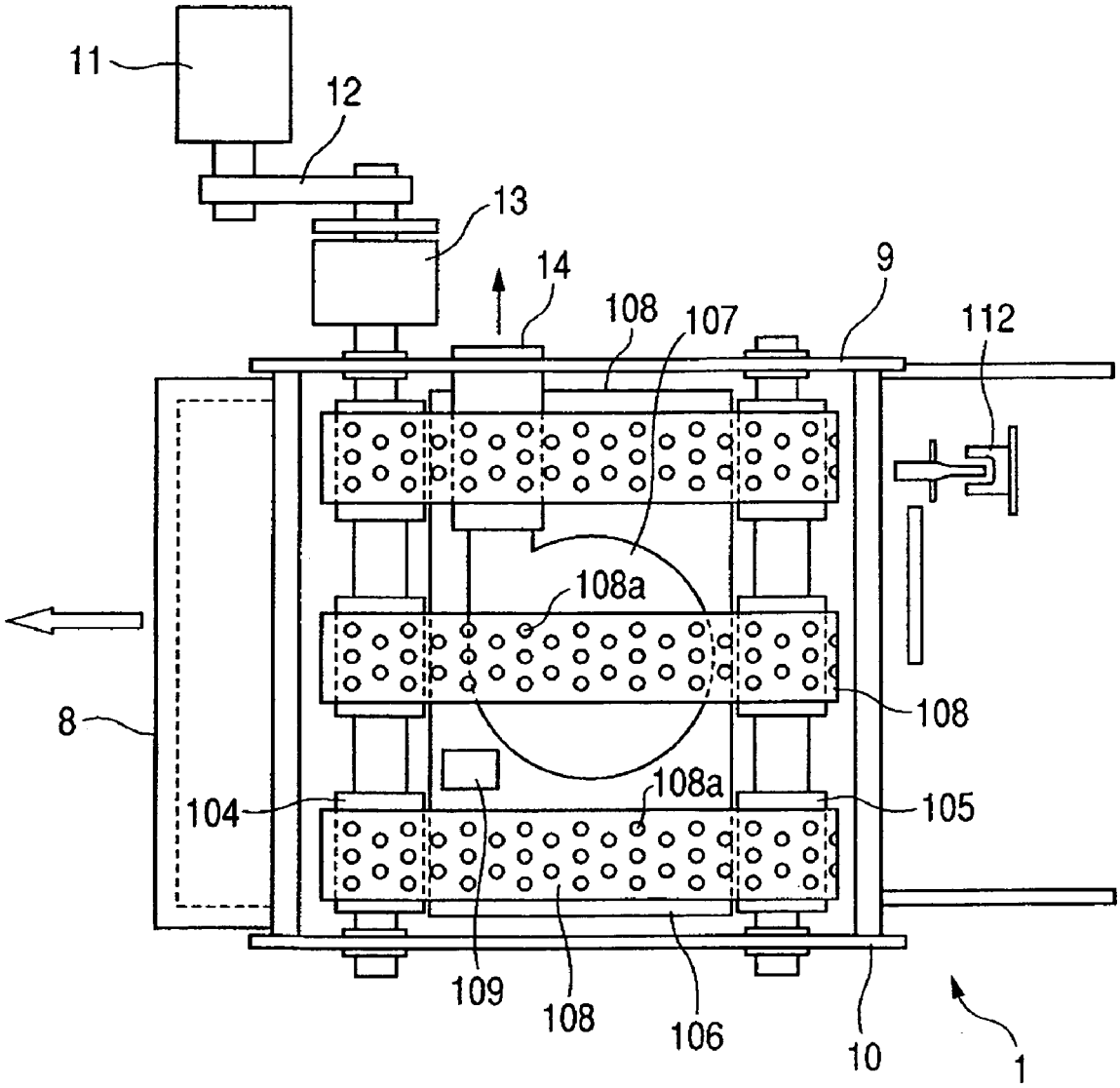
FIG. 3 is a plan view of the sheet feeding apparatus.

By the way, the sheet feeding apparatus 1 includes, as shown in FIGS. 2 and 3, three lines of endlessly-formed conveying belts 108 each formed with a plurality of round holes 108*a* in predetermined positions. This conveying belt 108 is looped round a pair of rollers 104, 105 with predetermined tension and is rotated by a sheet feeding motor 11 classified as a DC motor. Then, a rotational driving force of the sheet feeding motor 11 is transmitted to the pair of rollers 104, 105 via timing belt 12 and an electromagnetic clutch 13, whereby the conveying belt 108 is moved. It is to be noted that the pair of rollers 104, 105 are rotatably supported by frames 9, 10 of the sheet feeding apparatus 1.

Further, a suction fan 107 defined as a centrifugal separation type fan is disposed on an inner peripheral side of the conveying belt 108, and the suction fan 107 defined also as a suction portion (suction means) is disposed within a suction chamber 106, wherein a suction opening 106*a* of this suction chamber 106 is directed toward the side of the sheet S. On the other hand, a discharging duct 14 is disposed on the discharging side of the suction fan 107, and air suction by the suction fan 107 is released outside via this discharging duct 14. Moreover, an unillustrated opening/closing valve is provided in an interior of the discharging duct 14 and has a mechanism of opening and closing by ON-OFF of an adhesion solenoid 15 illustrated in FIG. 4.

Herein, when the adhesion solenoid 15 is OFF, the opening/closing valve comes to a closed state, and, when in this state, the air does not enter the suction fan 107, so that a pressure within the suction chamber 106 gets equal to an atmospheric pressure, wherein a negative pressure (suction force) is not generated. When switching ON the adhesion solenoid 15, however, the opening/closing valve comes to an opened state, and, when in this state, the negative pressure occurs in the interior of the suction chamber 106. Then, when the negative pressure thus occurs in the interior of the suction chamber 106, the sheet S1 is adsorbed toward the suction chamber 106. Note that the pressure in the suction chamber when the opening/closing valve comes to the opened state is set on the order of, e.g., −60 mmAq.

The numeral 109 designates an adsorption sensor for detecting that the uppermost sheet S1 is adsorbed to the conveying belt 108, and the numeral 112 denotes a sheet height detection sensor for detecting a position of the uppermost sheet S1. The numeral 111 represents a sheet feed sensor for detecting that the adsorption-conveyed sheet reaches a draw-out roller pair 110 and is conveyed while being pinched by the draw-out roller pair 110. Further, a sheet tray 5 provided in a liftable manner at the sheet feeding deck 2 defined as a sheet storage portion and stacked with the sheets is lifted and lowered by a lifting-and-lowering tray motor 16 (shown in FIG. 4).

Disposed, as shown in FIG. 2, in the sheet tray 5 provided at the sheet feeding deck 2 is a deck heater 3 defined as a heating member composed of a silicon rubber surface-shaped heating substance, a carbon surface-shaped heating substance, a Nichrome wire-shaped heating substance, etc. Note that a meshed plate 4 is fitted to the upper surface of this deck heater 3 in order for the heat of the deck heater 3 to be transferred to the sheet S in the sheet feeding deck 2.

Herein, this deck heater 3 is constructed to reach approximately 60° C. by emitting the heat when electrified. The heat of this deck heater 3 becomes convection heat and convects in between the sheets S through a mesh 4*a* of the meshed plate 4, and the heat convecting in between the sheets evaporates a water content between the sheets. Then, the water content between the sheets is thus evaporated by the heat, whereby adhesion based on humidity between the sheets can be weakened even when the sheet S stored in the sheet feeding deck 2 is coated paper.

On the other hand, the sheet tray 5 is constructed of a member exhibiting a high thermal conductivity such as copper. The sheet tray 5 is constructed of this type of member and is thus contrived to be warmed up by receiving the heat from the deck heater 3 when the deck heater 3 emits the heat.

Moreover, as illustrated in FIG. 2, a duct 6 is provided between a bottom portion of the sheet feeding deck 2 and the sheet tray 5. A centrifugal separation type separating fan 7 is disposed downwardly of an opening portion 6*a* of the duct 6 serving as an air duct disposed in the vicinity of the deck heater 3. Then, when rotating this separating fan 7 at a predetermined number of revolutions, the air in the duct 6 is suctioned by the separating fan 7 and flows in an arrowhead direction.

Further, a separating duct 8 is connected to a discharge port 7*a* of the separating fan 7, and a front end of this separating duct 8 is provided with a raveling nozzle 8*a* and a separating nozzle 8*b* that discharge the air blown from the separating fan 7. Note that this separating duct 8 has, as shown in FIG. 2, a widthwise-directional length enough to face all the three conveying belts 108. Therefore, the raveling nozzle 8*a* and the separating nozzle 8*b* can discharge the air entirely in the widthwise direction orthogonal to the sheet conveying direction of the sheet adsorbed to the conveying belt 108.

Figure 5:
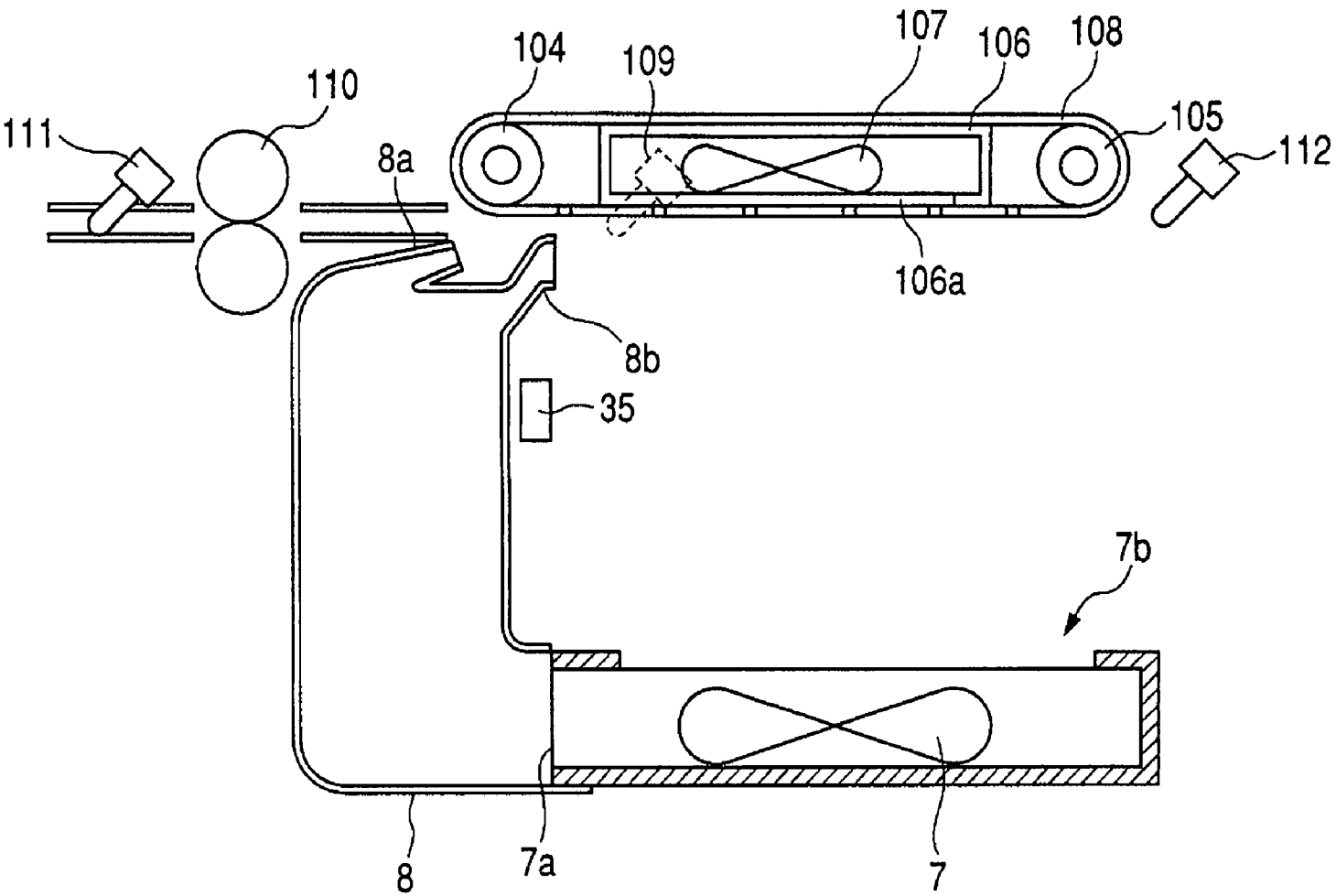
FIG. 5 is a view showing a state when a sheet feeding deck of the sheet feeding apparatus is removed from a printer body.

Note that FIG. 5 shows a state when the sheet feeding deck 2 is removed from the printer body 20A. When in this state, a suction opening portion 7*b* positioned upwardly of the separating fan 7 is opened, however, when the sheet feeding deck 2 is attached to the printer body 20A, this suction opening portion 7*b* is formed to get coincident with the opening portion 6*a* of the duct 6 as shown in FIG. 2. It is to be noted that the sheet feeding deck 2 is drawn out and inserted in the way of being guided by an Accuride rail 35 shown in FIG. 5 that is provided along the printer body 20A.

Herein, the duct 6 is disposed in the vicinity of the deck heater 3, whereby the air in the duct 6 is warmed up by the deck heater 3. Then, when the separating fan 7 rotates, the air warmed up within the duct 6 becomes the hot air and is thus sent to the separating duct 7 from the discharge port 7*a* of the separating fan 7.

It should be noted that the separating fan 7 defined as an air blowing portion, the separating duct 8 serving as the hot-air duct through which the hot air blown by the separating fan 7 passes, and the raveling nozzle 8*a* and the separating nozzle 8*b* that are defined as an air blowing portion for blowing the hot air toward the sheet from the separating duct 8, configure an air blowing portion for blowing the air toward the sheet stacked in the sheet feeding deck 2 in the present embodiment. Moreover, the raveling nozzle 8*a* and the separating nozzle 8*b* are provided with an unillustrated valve controlled by a sheet feeding controller 100. The hot air can be discharged toward the sheet selectively from the raveling nozzle 8*a* or the separating nozzle 8*b*, depending on the closing/opening of this valve.

Then, the air blowing portion having this configuration is provided, whereby when the sheet tray 5 is warmed up by the heat emitted from the deck heater 3 after the sheet feeding deck 2 has been attached to the printer body 20A, the sheet S stacked in the sheet tray 5 is warmed up. Along with this, the air in the interior of the duct 6 arranged under this sheet tray 5 is warmed up by the heat emitted from the deck heater 3 that is transferred from the sheet tray 5, and, when the separating fan 7 rotates at this time, the hot air is discharged from the discharge port 7*a* of the separating fan 7.

Further, the thus-discharged hot air flows through the separating duct 8 at a predetermined timing in an operation sequence shown in FIG. 6 that will be explained later on and is discharged at first from the raveling nozzle 8*a* and hereafter from the separating nozzle 8*b* at a wind speed of 2 m/s.

Thus, the duct 6 is disposed in the vicinity of the deck heater 3 for warming up the sheet S, and the air in the duct 6 is heated by the heat evolved by the deck heater 3. Along with this arrangement, the duct 6 and the separating duct 8 are connected through an intermediary of the separating fan 7, and the air in the heated duct 6 is blown by the separating fan 7 toward the sheet S stacked in the sheet tray 5. With this operation, the single deck heater 3 can heat up both the sheet S stacked in the sheet tray 5 and the air blown against the sheet S stacked therein.

This contrivance simplifies the structure and enables the heat of the deck heater 3 to be efficiently utilized, whereby the electric power can be saved (energy saving). Further, it is possible to reduce adsorbability (adhesion) between the sheets such as with the coated sheets of which the surfaces are coated with a coat material composed of a coating material etc, and the sheets can be surely separated.

Note that the deck heater 3 may be set to have a fixed heating amount, however, a temperature sensor for detecting a temperature is provided within at least one of the sheet feeding deck 2 and the separating duct 8, and the heating amount of the deck heater 3 may also be adjusted based on the detection by the temperature sensor.

Figure 4:
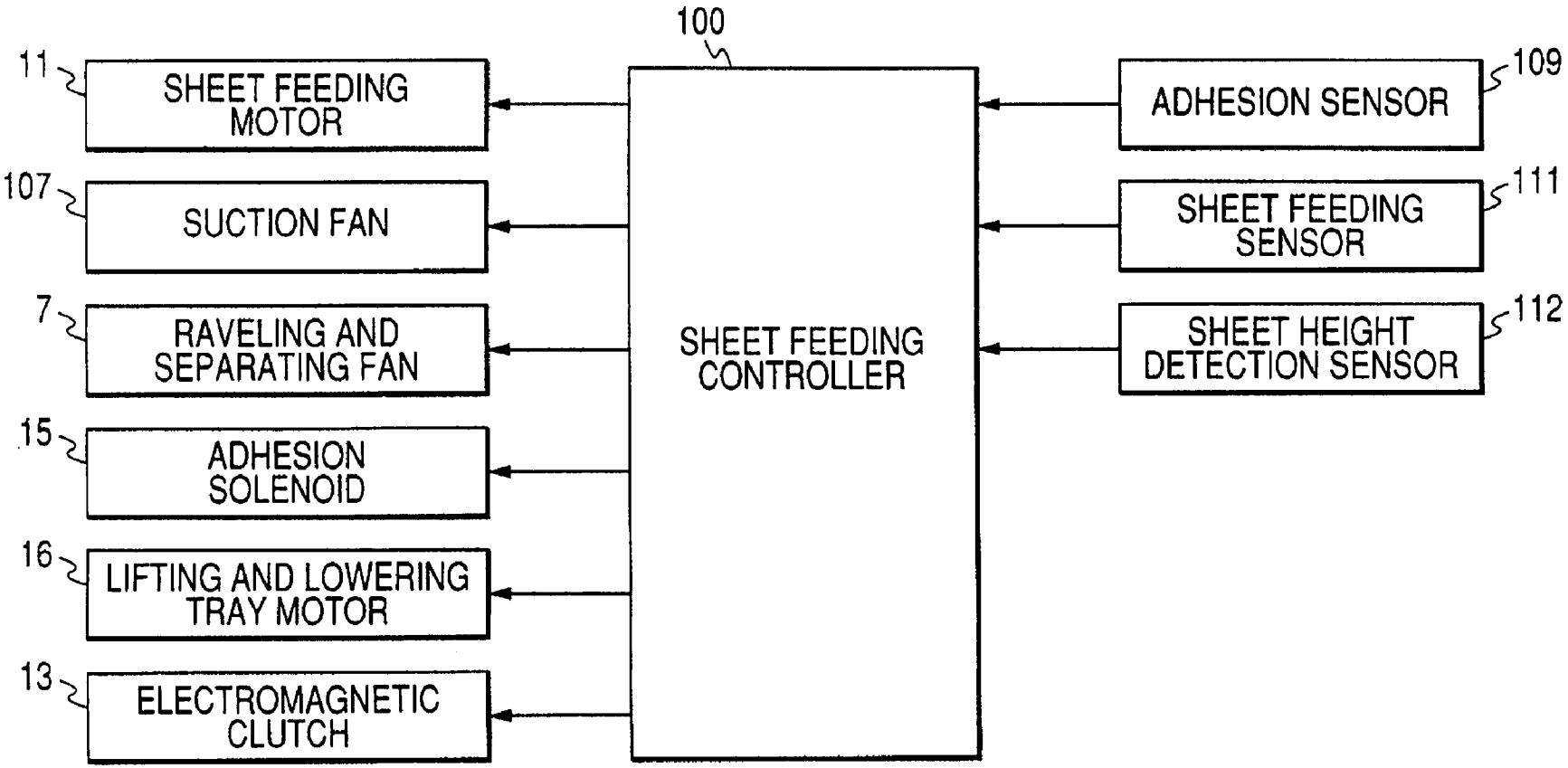
FIG. 4 is a control block diagram of the sheet feeding apparatus.

FIG. 4 is a control block diagram for controlling the sheet feeding apparatus 1. Detection signals from an adhesion sensor 109, a sheet feeding sensor 111 and a sheet height detection sensor 112 are inputted to the sheet feeding controller 100. Based on these detection signals, the sheet feeding controller 100 controls, as in an operation sequence in FIG. 6, the sheet feeding motor 11, the suction fan 107, the raveling/separating fan 7, the adhesion solenoid 15, the lifting-and-lowering tray motor 16 and the electromagnetic clutch 13.

Herein, the operation sequence of the sheet feeding apparatus 1 will be described with reference to FIG. 6.

Figure 6:
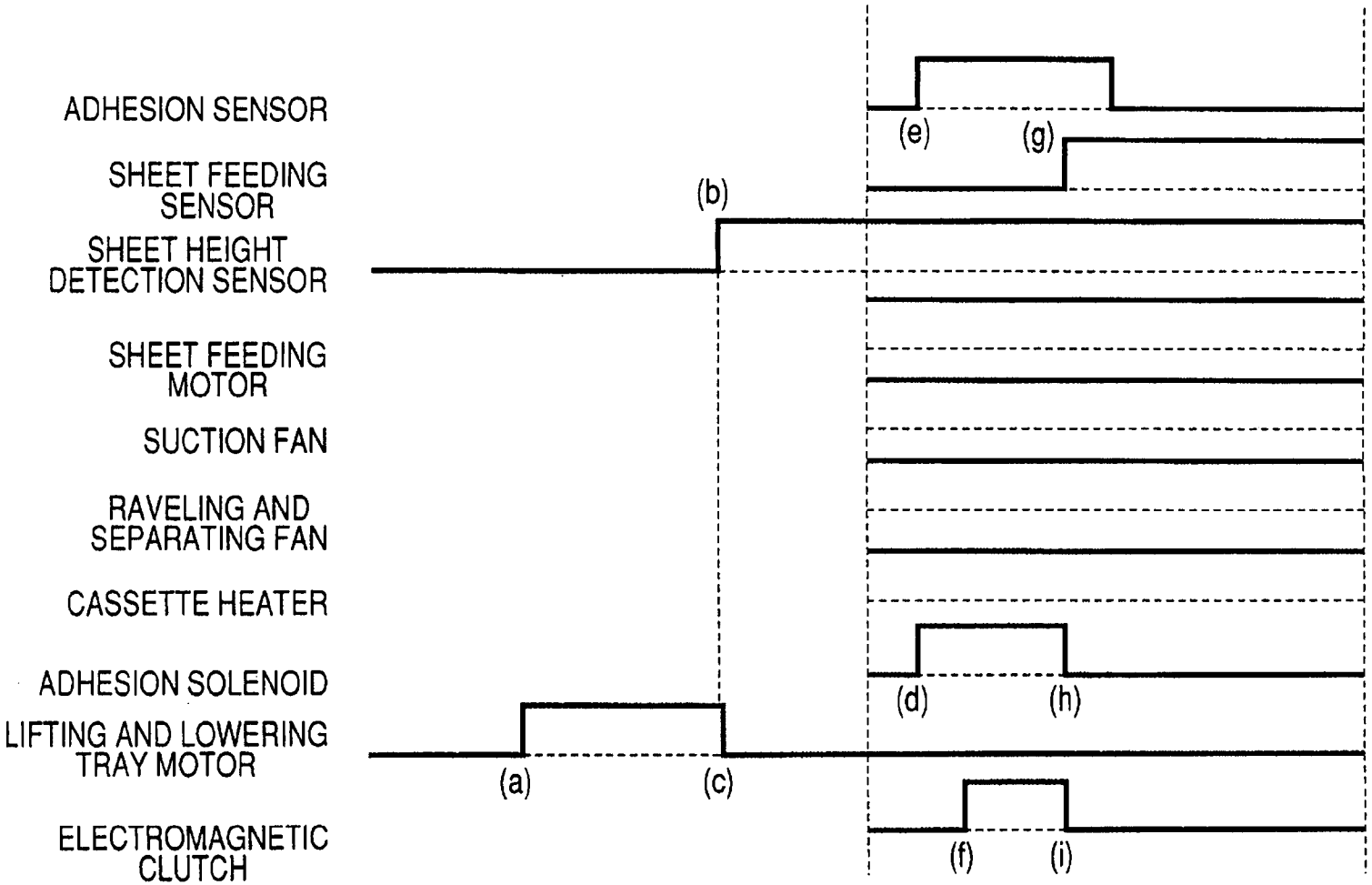
FIG. 6 is a sequence diagram when feeding the sheets by the sheet feeding apparatus.

As shown in FIG. 6, to start with, the sheet feeding controller 100 (see FIG. 4), as a pre-operation for feeding the sheet, lifts the sheet tray 5 by switching ON the lifting-and-lowering tray motor 16 at timing (a). Then, the sheet feeding controller 100 switches OFF the lifting-and-lowering tray motor 16 simultaneously with timing (b) when the sheet height detection sensor 112 (see FIGS. 2 and 3) detects the upper surface of the sheet S at the timing (b) or at a slightly delayed timing (c), thereby stopping the lifting of the sheet tray 5.

Thereafter, before the start of feeding the sheet, the sheet feeding motor 11, the suction fan 107, the raveling/separating fan 7 and the deck heater 3 that will be described later on, are previously switched ON. With this operation, the sheet S in the sheet feeding deck 2 is warmed up, and the adsorbability (adhesion) between the sheets S is decreased, and, as illustrated in FIG. 2, the air having the wind speed of 2 m/s is blown out obliquely upward from the side of the sheet stack by the raveling nozzle 8*a*, whereby some upper sheets of the sheet stack get floating.

Next, the opening/closing valve is opened by switching ON the adhesion solenoid 15 at timing (d), whereby the air in the suction chamber 106 is set in the negative pressure and the floated uppermost sheet S1 is adsorbed onto the conveying belt 108. Then, when the adhesion sensor 109 (see FIGS. 2 and 3) detects that this sheet has been adsorbed onto the conveying belt 108 at timing (e), the electromagnetic clutch 13 is switched ON at timing (f). With this operation, the conveying belt 108 is moved in the sheet feeding direction, thus starting feeding the sheet.

Note that at this time the separation air having the wind speed of 2 m/s is blown approximately in the horizontal direction out of the separating nozzle 8*b* shown in FIG. 2, and hence, even when the two sheets are adsorbed onto the conveying belt 108, the lower sheet S is peeled off and thus separated in the downward direction.

Next, when the leading end of the separated-and-fed sheet S1 reaches the sheet feeding sensor 111 (see FIG. 2) at timing (g), the adhesion solenoid 15 and the electromagnetic clutch 13 are switched OFF at timing (h) and timing (i). Upon this operation, the conveying belt 108 stops conveying the sheet S1, and thereafter the sheet S1 is conveyed by a downstream-side roller 110 (see FIG. 2). What has been described so far is the sheet feeding sequence for one sheet, and it follows that the same sequence is repeated when consecutively feeding the sheets.

Next, a second embodiment of the present invention will be explained with reference to FIGS. 7 and 8.

Figure 7:
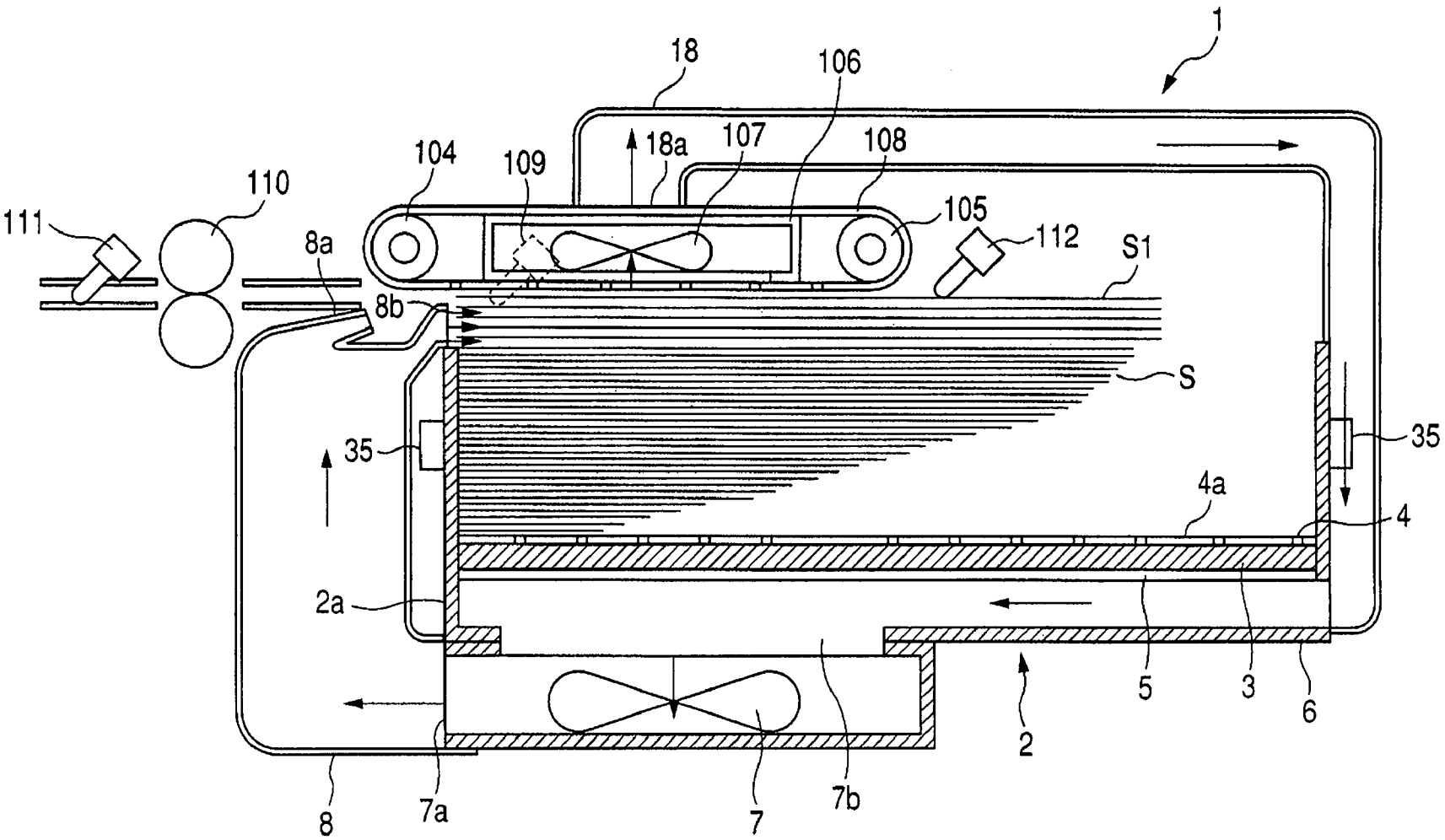
FIG. 7 is a view showing a configuration of the sheet feeding apparatus in a second embodiment of the present invention.

FIG. 7 is a view showing a construction of the sheet feeding apparatus according to the second embodiment. FIG. 8 is a view showing a state when there is none of the sheet feeding deck 2 of the sheet feeding apparatus 1. Note that the same numerals and symbols as those in FIGS. 2 and 5 represent the same or corresponding portions in FIGS. 7 and 8.

Figure 8:
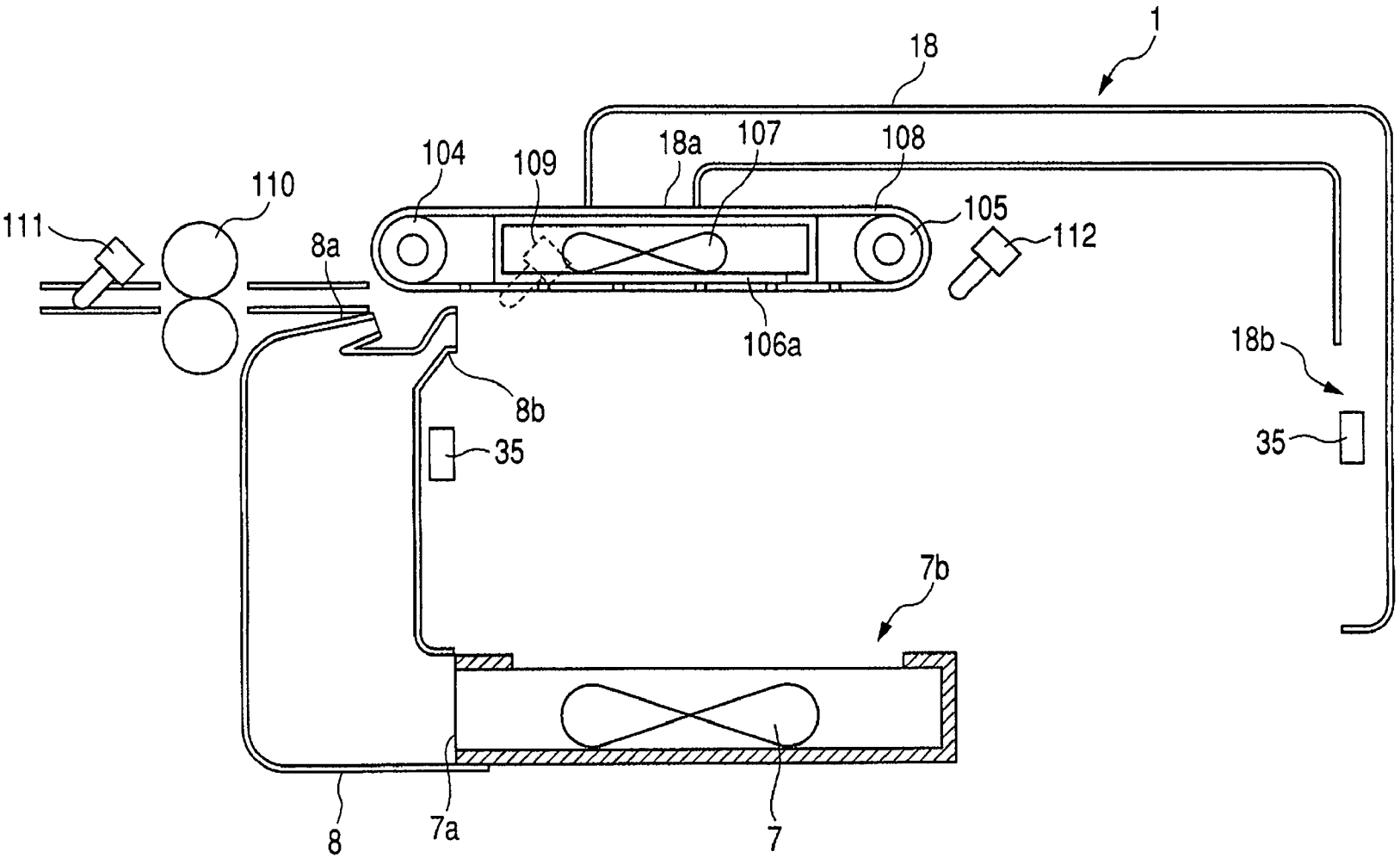
FIG. 8 is a view showing a state when there is none of the sheet feeding deck of the sheet feeding apparatus.

In FIGS. 7 and 8, the numeral 18 designates a relay duct. A suction opening portion 18*a* of this relay duct 18 is provided in an upper portion of the suction chamber 106. Further, a discharge port 18*b*, shown in FIG. 8, of the relay duct 18 is, as illustrated in FIG. 7, connected to the duct 6 formed at the bottom portion of the sheet feeding deck 2 when the sheet feeding deck 2 is attached to the printer body 20A.

Then, when providing the relay duct 18 serving as an air collecting portion, the hot air discharged from the raveling nozzle 8*a* and the separating nozzle 8*b* flows into the interior of the suction chamber 106 by dint of rotations of the suction fan 107 and further flows into the relay duct 18. Thereafter, the hot air flows forward again to the duct 6 via the relay duct 18.

Namely, the hot air circulates along the periphery of the sheet feeding deck 2 by thus providing the relay duct 18 between the suction chamber 106 and the duct 6. Then, the hot air is thus circulated, and it follows that the deck heater 3 warms up the air having a comparatively high temperature. It is therefore possible to decrease the heating amount of the deck heater 3. Namely, a temperature-controlled temperature can be set low by circulating the hot air, and further saving of the electric power (power saving) of the sheet feeding apparatus 1 can be expected. It is to be noted that in this case also, as explained in the first embodiment, the temperature control of the deck heater 3 may be conducted by use of the temperature sensor.

Moreover, if a side wall 2*a* of the sheet feeding deck 2 is composed of a member exhibiting a high heat conductivity such as copper, when the hot air flows through within the relay duct 18 and the separating duct 8 that are disposed adjacently to the sheet feeding deck 2, a temperature of the side wall 2*a* of the sheet feeding deck 2 rises due to the temperature thereof. With this rise in temperature, the sheet S stored in the interior of the sheet feeding deck 2 is warmed up, and, as a result, it is feasible to reduce the adsorbability (adhesion) between the sheets and therefore surely separate the sheets.

Next, a third embodiment of the present invention will hereinafter be described with reference to FIGS. 9 and 10. It should be noted that the first and second embodiments have exemplified the examples where the present invention is applied to the sheet feeding apparatus of such a type as to adsorb the sheet onto the conveying belt by the air, however, the third embodiment will exemplify a construction in which the present invention is applied to the sheet feeding apparatus employing a retard roller type.

Figure 9:
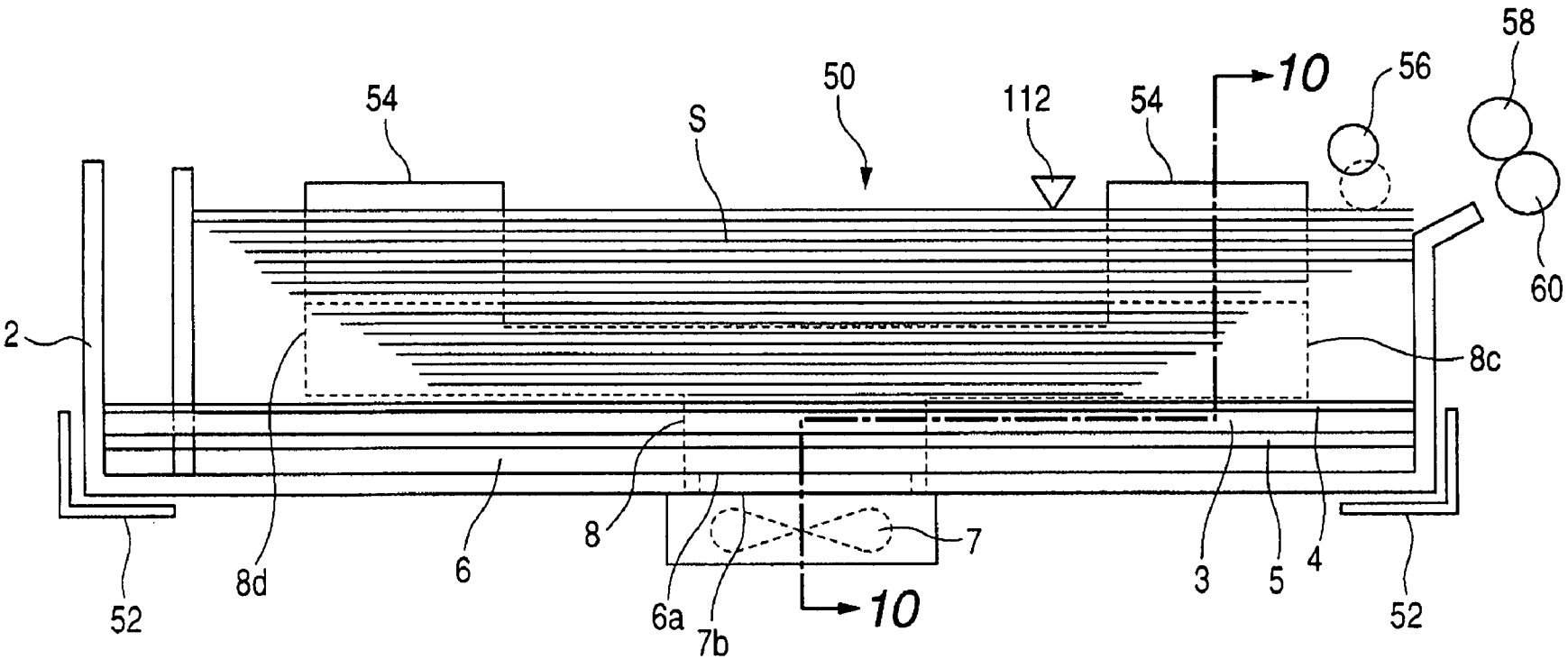
FIG. 9 is a vertical sectional view of the sheet feeding apparatus in a third embodiment of the present invention.
Figure 10:
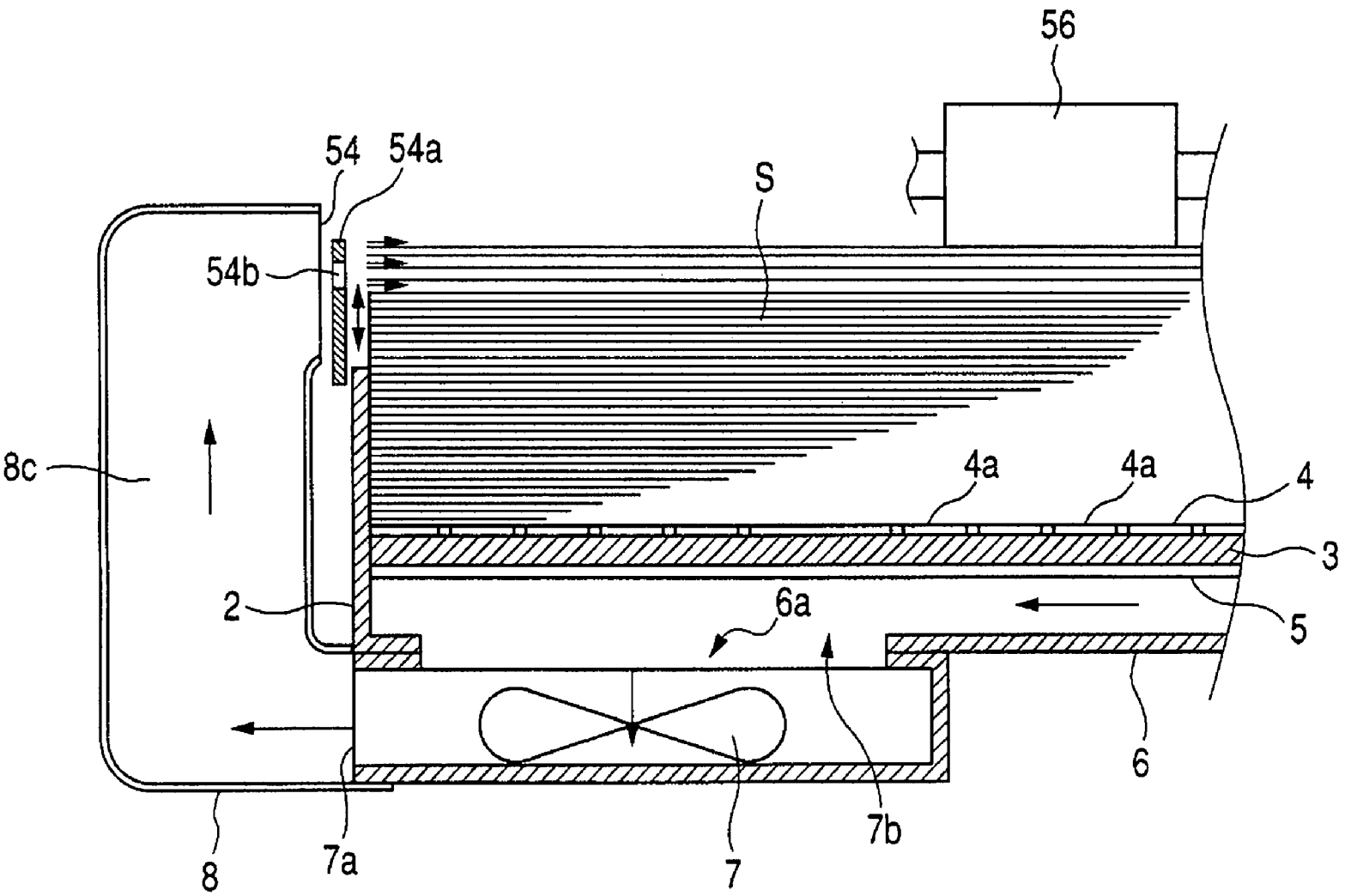
FIG. 10 is a sectional view taken along the line 10-10 in FIG. 9.
Figure 11:
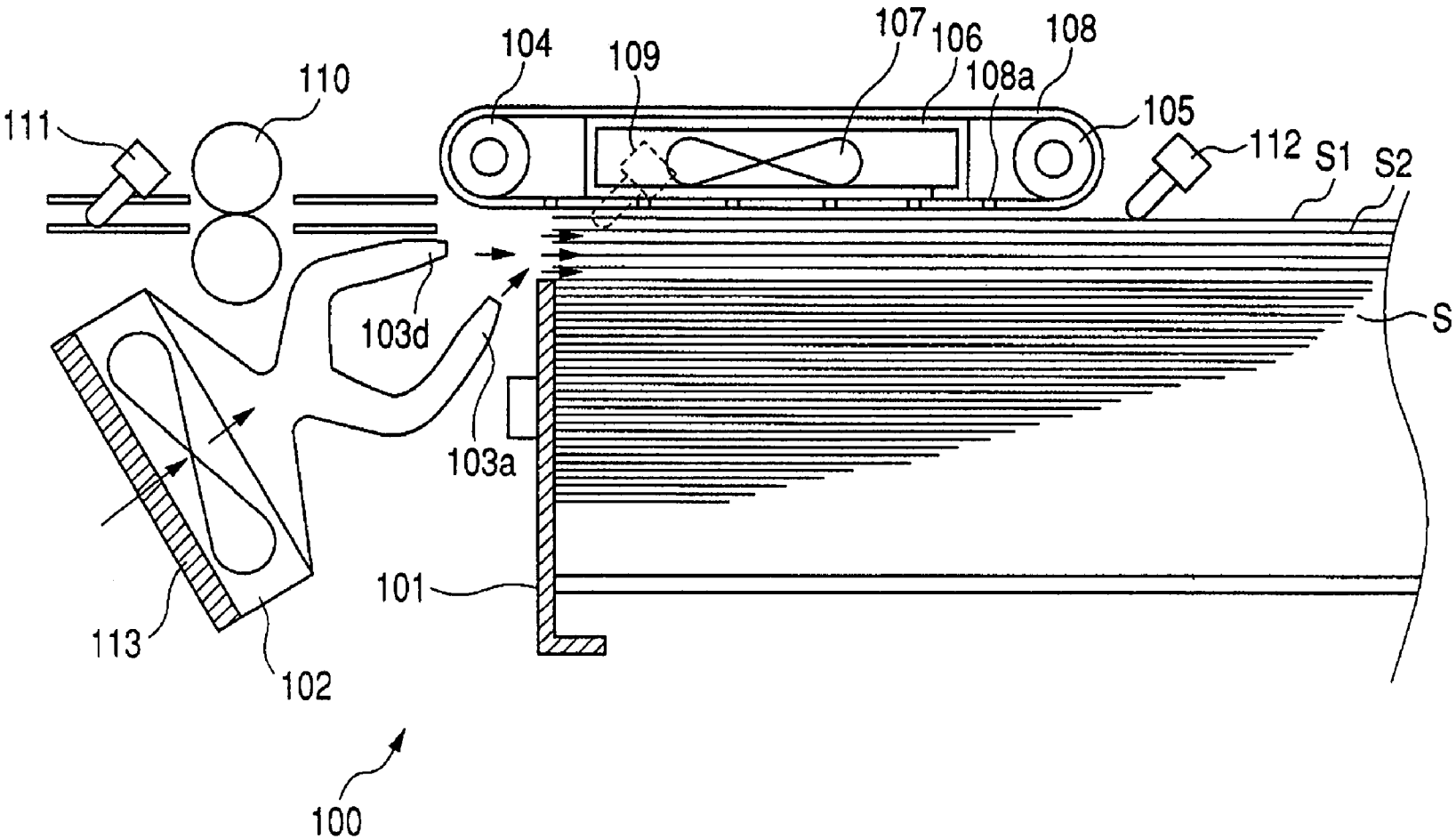
FIG. 11 is a view showing a configuration of a conventional sheet feeding apparatus.

FIG. 9 is a vertical sectional view of a sheet feeding apparatus 50. FIG. 10 is a sectional view taken along the line 10-10 in FIG. 9. Note that the explanation will focus on different portions from those in the first and second embodiments. Further, the same members or members having the same functions as those in the first and second embodiments are marked with the same numerals and symbols.

The sheet feeding apparatus 50 is provided with the sheet feeding deck 2 so as to be withdrawable in the perpendicular direction to the sheet surface along a rail 52. In the same way as in the first and second embodiments, the deck heater 3 defined as a heating member composed of a silicon rubber surface-shaped heating substance, a carbon surface-shaped heating substance, a Nichrome wire-shaped heating substance, etc is disposed in the sheet tray 5 provided at the sheet feeding deck 2. Note that the meshed plate 4 is fitted to the upper surface of this deck heater 3 in order for the heat of the deck heater 3 to be transferred to the sheet S in the sheet feeding deck 2. It is to be noted that the lifting and lowering of the sheet tray 5 is controlled based on the detection by the sheet height detection sensor 112.

A pickup roller 56 is provided in an ascendable/descendable manner upwardly of the stacked sheet S. The pickup roller 56, when lowered, abuts on the sheet and thus feeds the sheet out. Provided on a downstream side of the pickup roller 56 is a separating portion constructed of a feed roller 58 rotating in the sheet conveying direction and of a separating roller 60 driven with a predetermined torque in the direction reversed to the sheet conveying direction and abutting on the feed roller 58 with a predetermined pressure. Then, this separating portion permits passage of only the uppermost sheet of the sheet stack fed out by the pickup roller 56 and returns other sheets that have been fed out following the uppermost sheet.

The duct 6 is provided between the bottom portion of the sheet feeding deck 2 and the sheet tray 5, and the centrifugal separation type separating fan 7 is disposed downwardly of the opening portion 6*a* of the duct 6 serving as the air duct disposed in the vicinity of the deck heater 3. Then, when rotating this separating fan 7 at a predetermined number of revolutions, the air in the duct 6 flows through the suction opening portion 7*b* and is sucked by the separating fan 7. The separating duct 8 is connected to the discharge port 7*a* of the separating fan 7 and branches off midways into a front-side separating duct 8*c* and a rear-side separating duct 8*d*, which are connected to air blowing ports 54, 54 each having the same configuration.

Herein, the separating fan 7 defined as an air blowing portion, the separating duct 8 defined as a hot air duct through which the hot air blown by the separating fan 7 flows and the air blowing ports 54, 54 defined as air blowing portions for blowing out the hot air toward the sheet S from the separating duct 8, configure an air blowing portion for blowing the air toward the sheet S stacked in the sheet feeding deck 2.

The air blowing ports 54, 54 are opened to the upper side surface of the stacked sheet S, and a shutter 54*a* moving up and down is disposed along the opening portions thereof. This shutter 54*a* is formed with a slit 54*b*, and this slit 54*b* enhances a raveling effect of the sheet S by accelerating the wind speed of the air blown out of the air blowing ports 54, 54 and shifting the blowout position up and down.

With this configuration, the air heated by the deck heater 3 is blown against the side end surface of the sheet from the air blowing ports 54, 54 through the separating duct 8 (the front-side separating duct 8*c* and the rear-side separating duct 8*d*) by previously rotating the separating fan 7 before feeding the sheet. With this operation, the upper portions of the sheets S are raveled, and the sheets S fed by the pickup roller 56 can be surely separated sheet by sheet by the separating portion.

Note that the air may be blown not only before the feeding operation of the sheet S but also during the feeding operation. Further, as in the second embodiment, the air blown out of the air blowing ports 54, 54 may be returned again to the duct 6 by providing the relay duct. In this case, a suction port of the relay duct may be disposed in a position facing the air blowing ports 54, 54 at a side portion opposite to the side portion of the sheet, wherein the air blowing ports 54, 54 are provided. Further, the temperature control of the deck heater 3 may also be adjusted as described in the first embodiment.

Note that in the embodiments described above, the deck heater 3 provided at the sheet tray 5 heats up the sheet stacked in the sheet tray 5 and the air discharged from the raveling nozzle 8*a* and the separating nozzle 8*b*. The present invention is not, however, limited to this heating method, another heating method may be such that the heater defined as a heating portion is disposed on the side of the air blowing portion (for example, the heater is disposed within the separating duct 8), and the sheet tray and the respective nozzles are supplied with the air heated up by the fan, thereby heating up the sheet tray and the air to be blown.

This application claims priority from Japanese Patent Application No. 2005-027529 filed Feb. 3, 2005, which is hereby incorporated by reference herein.

What is claimed is:

1. A sheet feeding apparatus comprising:

a sheet tray supporting a plurality of sheets;

a sheet feeding device that feeds out the sheets stacked in said sheet tray;

an air blowing device that blows air toward the sheets stacked in said sheet tray;

a heating member, disposed between said sheet tray and sheets to be stacked therein, that generates heat to heat air and is arranged so as to also apply the heat to the plurality of sheets on said sheet tray; and an air duct disposed on a side opposite to said heating member with respect to said sheet tray and connected to said air blowing device to guide the air heated by said heating member to said air blowing device, wherein the air in said air duct heated by heat conducted via said sheet tray from said heating member is blown toward the sheets stacked in said sheet tray by said air blowing device.

2. A sheet feeding apparatus according to claim 1, wherein said air blowing device includes a fan blowing the heated air in said air duct that is heated by the heating member, and a nozzle is provided in said air duct for blowing out the heated air toward the sheets.

3. A sheet feeding apparatus according to claim 1, further comprising an air collecting portion constructed to collect the heated air to be blown by said air blowing device and to return the air to said air duct.

4. A sheet feeding apparatus according to claim 3, wherein said sheet feeding device includes a conveying belt provided upwardly of said sheet tray and suction means that is provided inside said conveying belt, wherein said suction means absorbs the sheet floated by blowing the air against the sheet from said air blowing device provided in the front of the sheets stacked in said sheet tray, onto said conveying belt, and said conveying belt conveys the absorbed sheet, and said air collecting portion collects the air blown out of said air blowing device through said suction means and returns the collected air to said air duct.

5. A sheet feeding apparatus according to claim 3, further comprising a sheet storing portion provided in an ascendable or descendable manner with said sheet tray stacked with the plurality of sheets, wherein said air collecting portion is disposed adjacently to said sheet storing portion.

6. A sheet feeding apparatus according to claim 5, wherein said air duct is disposed adjacently to said sheet storing portion.

7. A sheet feeding apparatus according to claim 6, wherein a side wall, facing said air duct, of said sheet storing portion is composed of a copper.

8. An image forming apparatus comprising:

a sheet feeding apparatus according to any one of claims 1, 2 and 3 through 7; and an image forming portion that forms an image on a sheet fed out of said sheet feeding apparatus.

* * * * *

UNITED STATES PATENT AND TRADEMARK OFFICE

CERTIFICATE OF CORRECTION

PATENT NO. : 7,364,150 B2
APPLICATION NO. : 11/342596
DATED : April 29, 2008
INVENTOR(S) : Nakane It is certified that error appears in the above-identified patent and that said Letters Patent is hereby corrected as shown below:

COLUMN 2:
Line 23, “vanished,” should read --eliminated,--.

COLUMN 3:
Line 8, “sensor ill” should read --sensor 111--.
Line 33, “get floating” should read --are made to float--.

COLUMN 5:
Line 40, “comes to” should read --enters--.
Line 42, “gets” should read --becomes--.
Line 45, “comes to” should read --enters--.
Line 51, “comes to” should read --enters--.

COLUMN 6:
Line 48, “get coincident” should read --coincide--.
Line 66, “sheet” (first occurrence) should read --sheets--.

COLUMN 7:
Line 10, “sheet” (first occurrence) should read --sheets--, and “is” should read --are--.
Line 24, “sheet” should read --sheets--.
Line 29, “sheet” (first occurrence) should read --sheets--.

COLUMN 8:
Line 5, “sheet” (first occurrence) should read --sheets--, and “is” should read --are--.
Line 10, “get floating.” should read --are made to float.--.

COLUMN 9:
Line 9, “within” should be deleted.
Line 13, “sheet” should read --sheets--.
Line 14, “is” should read --are--.
Line 49, “sheet” should read --sheets--.

UNITED STATES PATENT AND TRADEMARK OFFICE

CERTIFICATE OF CORRECTION

PATENT NO. : 7,364,150 B2
APPLICATION NO. : 11/342596
DATED : April 29, 2008
INVENTOR(S) : Nakane It is certified that error appears in the above-identified patent and that said Letters Patent is hereby corrected as shown below:

COLUMN 10:
Line 11, “sheet” should read --sheets--.
Line 13, “sheet” (first occurrence) should read --sheets--.
Line 16, “sheet” should read --sheets--.
Line 19, “sheet” should read --sheets--.

COLUMN 12:
Line 20 claim 8, “1, 2 and 3 through 7;” should read --1 through 7;--.

Signed and Sealed this

Twentieth Day of January, 2009

JON W. DUDAS
*Director of the United States Patent and Trademark Office*